US006624716B2

(12) United States Patent
Goff

(10) Patent No.: US 6,624,716 B2
(45) Date of Patent: Sep. 23, 2003

(54) MICROSTRIP TO CIRCULAR WAVEGUIDE TRANSITION WITH A STRIPLINE PORTION

(75) Inventor: Miles E. Goff, Carlisle, MA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/037,789

(22) Filed: Jan. 3, 2002

(65) Prior Publication Data

US 2003/0122634 A1 Jul. 3, 2003

(51) Int. Cl.[7] ..... H01P 5/107

(52) U.S. Cl. ..... 333/26; 333/33; 343/859

(58) Field of Search ..... 333/26, 33; 343/859; H01P 5/107

(56) References Cited

U.S. PATENT DOCUMENTS 4,052,683 A * 10/1977 van Heuven et al. ..... 333/26 X
4,412,354 A * 10/1983 Hu ..... 455/327

FOREIGN PATENT DOCUMENTS

DE 3330099 A1 * 3/1985 ..... H01P/1/00
JP 05335815 A * 12/1993 ..... H01P/5/107

* cited by examiner

*Primary Examiner*—Justin P. Bettendorf
(74) *Attorney, Agent, or Firm*—Daly, Crowley & Mofford, LLP

(57) ABSTRACT

A microstrip to circular waveguide transition having an elongated circular waveguide portion and a stripline circuit portion disposed within the waveguide portion. The stripline includes a strip conductor disposed in a strip conductor plane. The strip conductor extends along a longitudinal axis of the circular waveguide portion from a first region of the transition to a longitudinally spaced second region of the transition. The stripline circuit portion includes a pair of overlying ground planes extending along the longitudinal axis from the first region to the second region, such pair of ground planes being disposed in overlying planes parallel to the strip conductor plane. The strip conductor is spaced from a pair of diametrically opposed first portions of the sidewalls in the first region and bends towards a first of a pair of diametrically opposed second portions of the sidewalls and away from a second one of the pair of opposed second portions of the sidewalls as such strip conductor extends within the waveguide portion towards the second region. The pair of overlying ground planes is disposed adjacent the diametrically opposed sidewall portions of the sidewalls in the first region of the transition and bend away from the first one of the pair of diametrically opposed second portions of the sidewalls and towards the second one of the diametrically opposed second portions of the sidewalls as such pair of ground planes extends within the waveguide section towards the second region. With such an arrangement, the stripline circuit portion provides two symmetrically located ground planes, which make two symmetrical E, field vectors. X-axis components of these vectors add to excite the desired mode in the circular waveguide. Y-axis components of these two vectors are in opposite directions, and will thus cancel out the contribution of coupling to the undesired orthogonal mode in the circular waveguide. This cancellation, due to symmetry, is not related to any particular wavelength, and thus the phenomenon is very broadband.

11 Claims, 6 Drawing Sheets

MICROSTRIP TO CIRCULAR WAVEGUIDE TRANSITION WITH A STRIPLINE PORTION

TECHNICAL FIELD

This invention relates to microstrip to circular waveguide transitions and more particularly to microstrip to circular transitions having high mode purity

BACKGROUND

As is known in the art, modem microwave and millimeter wave transceiver modules use microstrip internal to the module for low cost interconnections using planar PC board technology. The connection to the antenna feed is often better done with circular waveguide, because of its low loss characteristics, its ability to have its polarization simply changed by rotating the module, and superior mechanical support characteristics. Some designs even use a nonstandard guide diameter, so the image frequency of the transceiver is below cutoff in the waveguide. Thus, there is a need for a low cost microstrip to circular waveguide transition, which can be manufactured using planar PC board technology. Since circular waveguide propagates two orthogonal modes with the same cutoff frequency, the mode purity of the transition becomes an issue, lest precious microwave energy be wasted in an inappropriate mode. The E field vectors in these two modes are 90 degrees with respect to each other.

Coaxial to circular waveguide transitions using antenna probes and backshorts are well known in the art. These devices transform the microwave energy from the TEM coaxial mode to the circular waveguide mode with its electric, E, field aligned with the antenna probe. These traditional methods are too expensive for use in a low cost transceiver module because they do not directly transform from microstrip.

An approach which uses microstrip to fin-shaped line (or finline) to circular waveguide transition 10 is illustrated in FIGS. 1, 2 and 2A–2E, which terminates in a circular waveguide 22 (FIG. 4). See Bhat & Koul, *Anaysis, Design, and Applications of Fin Lines,* Artech House, Norwood, Mass., 1987. FIG. 6.12, page 287. The transition 10 includes a microstrip circuit portion 11 disposed within, here along a diameter of, a circular waveguide portion 20. The microstrip circuit portion 11 includes a dielectric substrate 12 separating a ground plane 14 from strip conductor 16. The microstrip circuit portion 11 is disposed in the central region (here along a diameter of) the circular waveguide portion 20. The circular waveguide portion 20 has its longitudinal axis disposed along the Z-axis. The transition 10, shown at the left in FIG. 1, terminates in the circular waveguide 22, shown at the right of FIG. 1. The microwave energy is presumed to flow from left to right, with the X- and Y-axis of the coordinate system perpendicular to the axis of propagation, Z. Thus, the Z-axis is along the length of the microstrip circuit portion 10 and along the centerline of the circular waveguide portion 20. The electric field, E vector, in the region of predominantly the microstrip circuit portion 11 (FIG. 2A) propagation lies along the Y-axis, from the microstrip ground plane 14 to the microstrip strip conductor 16. In the middle portions of the transition 10 (FIGS. 2B, 2C and 2D), the ground plane 14 is gradually removed along one side (here from the right side in FIGS. 2B, 2C and 2D) to thereby concentrate the E field vector in this region. The strip conductor 16 is widened as it extends towards the right side in these middle regions and bent along fin-shaped lines 13, 17 (FIGS. 2C, and 2D) to electrically contact the ground wall of the circular waveguide portion 20 as shown in FIG. 2D directly opposite it. In this way the E field vector is persuaded to turn itself from a predominantly Y axis orientation to a predominantly X axis orientation, as determined by the placement of the conductors and the requirements of Maxwell's equations. This resultant E field vector rotation about the longitudinal Z-axis is illustrated in FIGS. 2A–2E.

The desired circular waveguide mode in this transition design has its E field vector aligned with the X axis, in the plane of the dielectric substrate 12 supporting the microstrip circuit portion 11. Nevertheless, a small but significant amount of energy remains aligned along the Y axis (i.e., normal to the plane of the dielectric substrate 12), as shown in FIG. 2E, and serves to excite the orthogonal mode in the circular waveguide 22 (FIG. 2F). This energy is wasted, and may cause other difficulties such as inexplicable narrow band resonant dips in the transmission band of the transceiver.

SUMMARY

In accordance with the present invention, a microstrip to circular waveguide transition is provided. The transition includes an elongated circular waveguide portion and a stripline circuit portion disposed within the circular waveguide portion. The stripline portion includes a strip conductor disposed in a strip conductor plane. The strip conductor extends along a longitudinal axis of the circular waveguide portion from a first region of the transition to a longitudinally spaced second region of the transition. The stripline circuit portion includes a pair of overlying ground planes extending along the longitudinal axis from the first region to the second region. The pair of ground planes is disposed in overlying planes parallel to the strip conductor plane. The strip conductor is spaced from a pair of diametrically opposed first portions of the sidewalls in the first region and bends towards a first of a pair of diametrically opposed second portions of the sidewalls and away from a second one of the pair of opposed second portions of the sidewalls as such strip conductor extends within the waveguide portion towards the second region. The pair of overlying ground planes is disposed adjacent the diametrically opposed sidewall portions of the sidewalls in the first region of the transition and bend away from the first one of the pair of diametrically opposed second portions of the sidewalls and towards the second one of the diametrically opposed second portions of the sidewalls as such pair of ground planes extends within the waveguide section towards the second region.

With such an arrangement, the stripline circuit portion provides two symmetrically located ground planes, which make two symmetrical E, field vectors. X-axis components of these vectors add to excite the desired mode in the circular waveguide. Y-axis components of these two vectors are in opposite directions, and will thus cancel out the contribution of coupling to the undesired orthogonal mode in the circular waveguide. This cancellation, due to symmetry, is not related to any particular wavelength, and thus the phenomenon is very broadband.

In one embodiment of the invention, the strip conductor plane is disposed along a diameter of the circular waveguide portion.

In one embodiment the strip conductor is in electrical contact with the first of the pair of diametrically opposed second portions of the sidewalls.

In one embodiment the pair of ground planes strip conductor is in electrical contact with the second one of the diametrically opposed second portions of the sidewalls.

In one embodiment the strip conductor is in electrical contact with the diametrically opposed sidewall portions of the sidewalls in the first region of the transition.

In one embodiment overlying edges of the pair of ground planes are disposed along a first fin-shaped line as such pair of ground planes extend from the first region to the second region.

In one embodiment overlying edges of the pair of ground planes are disposed along a second fin-shaped line as such pair of ground planes extend from the first region to the second region.

In one embodiment the first and second fin-shaped lines diverge one from the other in opposite directions in the second region.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
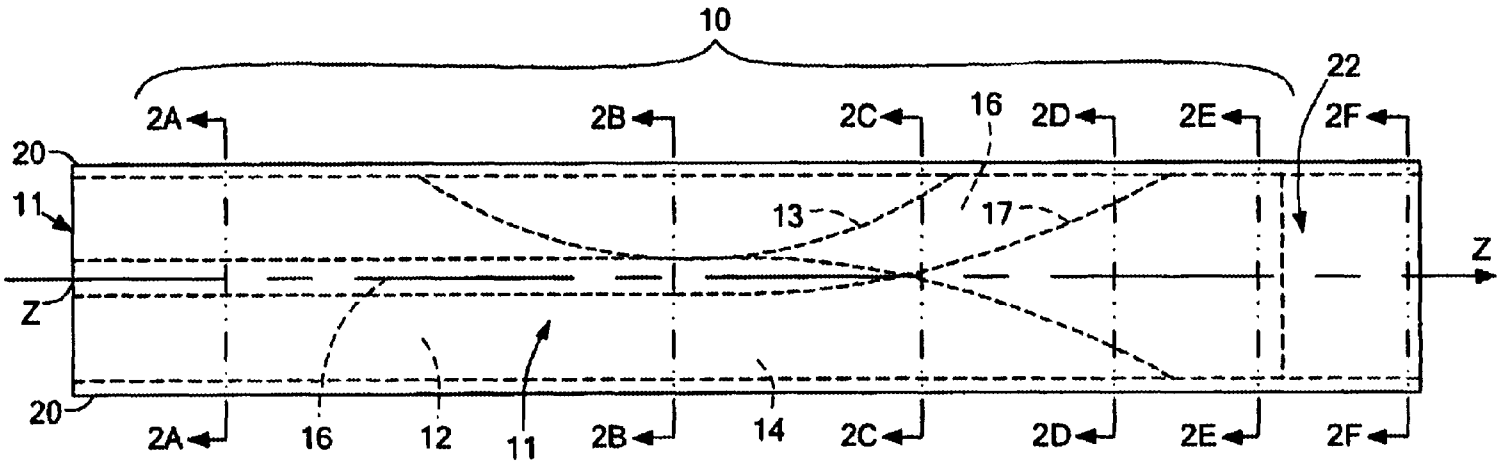
FIG. 1 Prior Art
FIG. 1 is a plan view of a microstrip to circular waveguide according to the PRIOR ART.
Figure 2:
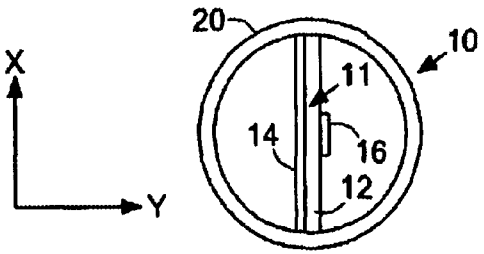
FIG. 2 Prior Art
FIG. 2 is an end view of the transition of FIG. 1 according to the PRIOR ART.
Figure 2A:
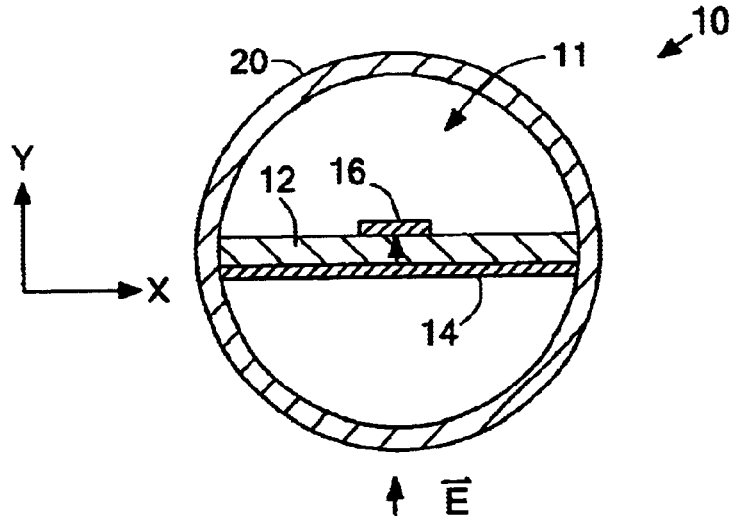
FIG. 2A Prior Art
FIGS. 2A–2F are cross-sectional views of the transition of FIG. 1, such cross-sections being taken along lines 2A—2A through 2F—2F, respectively in FIG. 1.
Figure 2B:
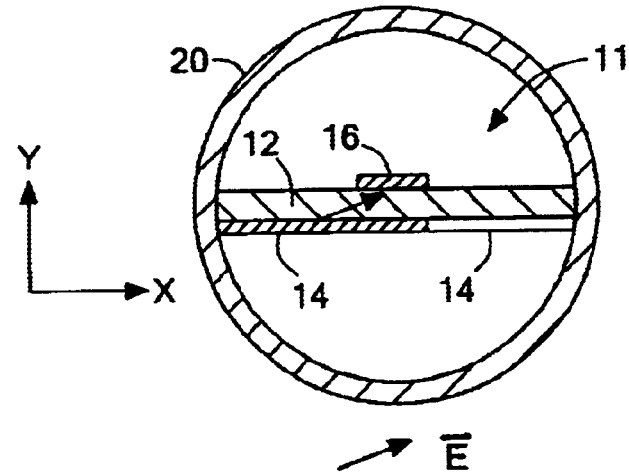
FIG. 2B Prior Art
Figure 2C:
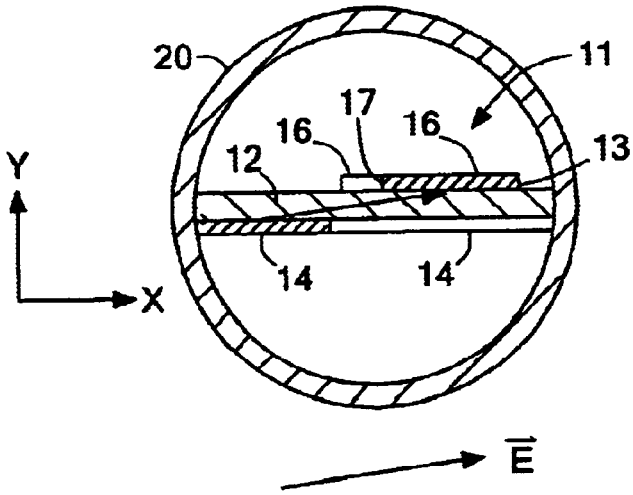
FIG. 2C Prior Art
Figure 2D:
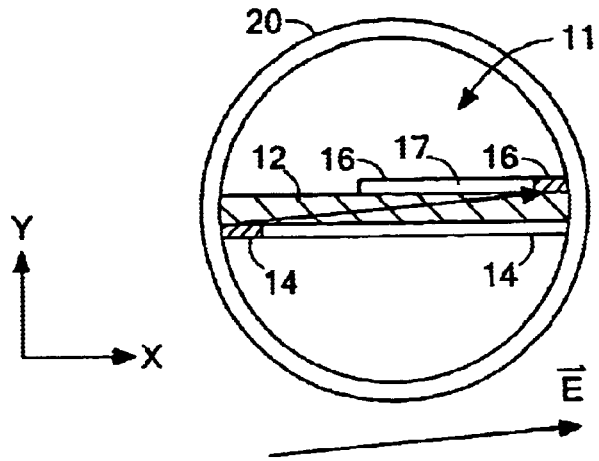
FIG. 2D Prior Art
Figure 2E:
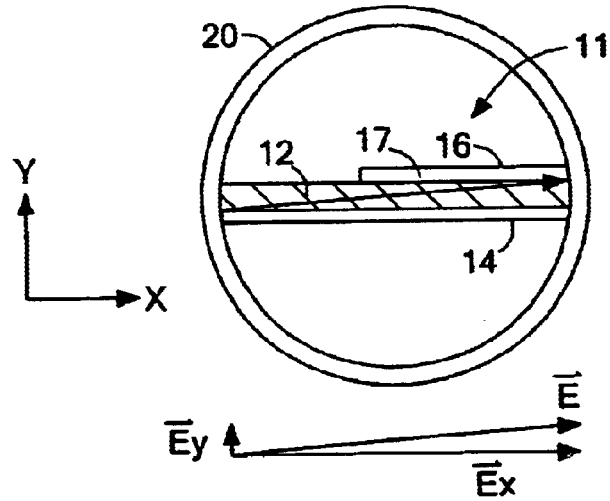
FIG. 2E Prior Art
Figure 2F:
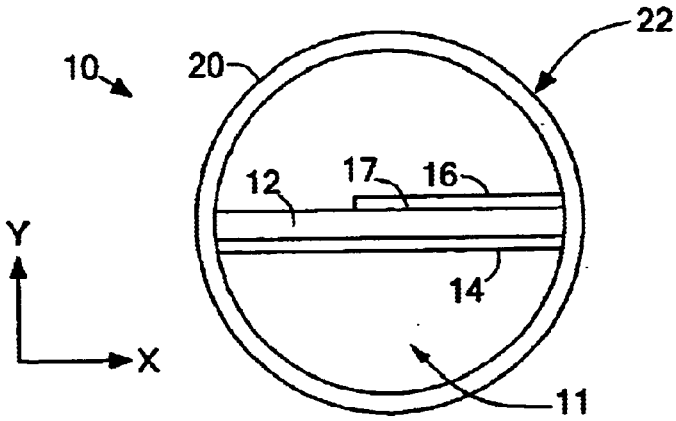
FIG. 2F Prior Art
Figure 3:
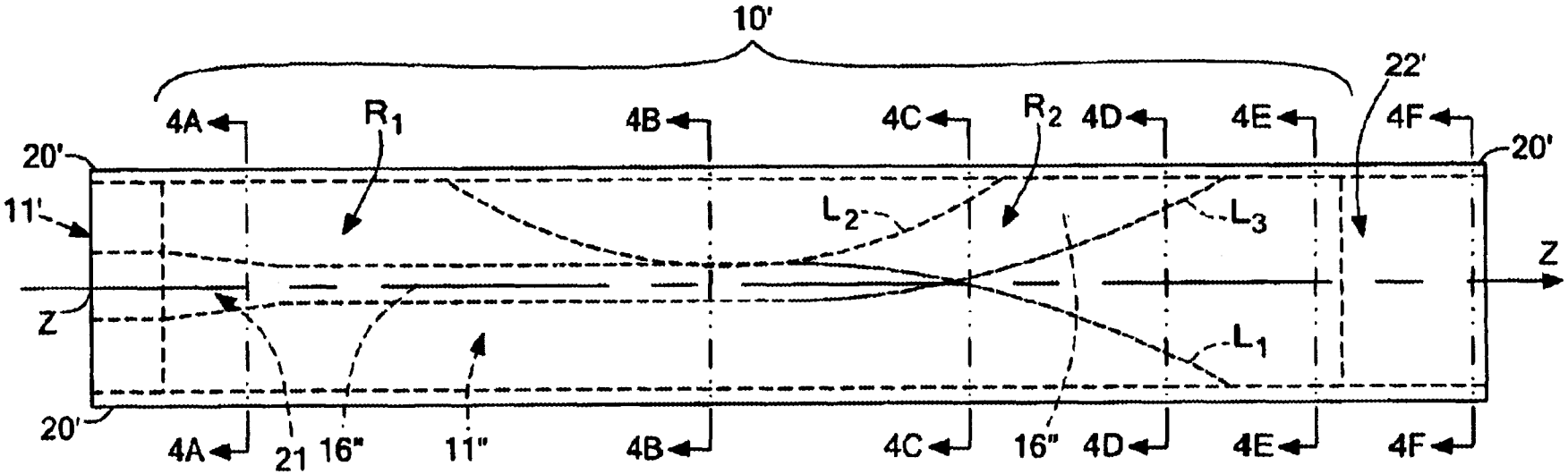
FIG. 3 is a plan view of a microstrip to circular waveguide transition according to the invention.
Figure 4:
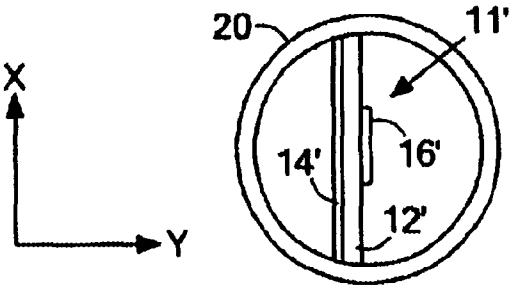
FIG. 4 is an end view of the transition of FIG. 3.
Figure 4A:
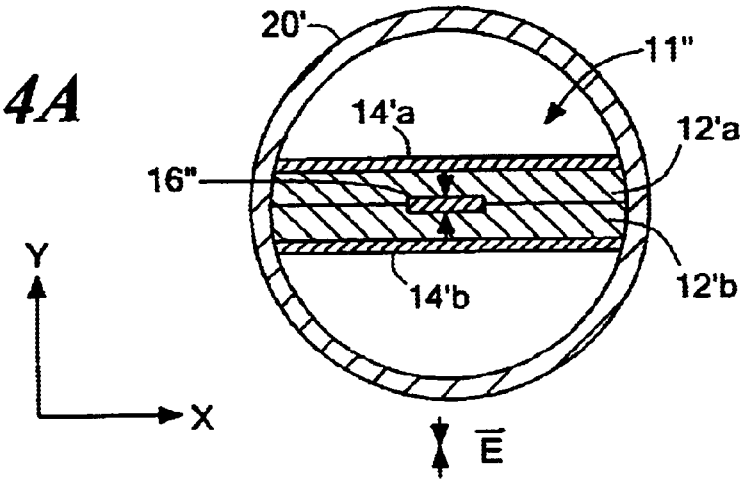
FIGS. 4A–4F are cross-sectional views of the transition of FIG. 3, such cross-sections being taken along lines 4A—4A through 4F—4F, respectively, in FIG. 3.
Figure 4B:
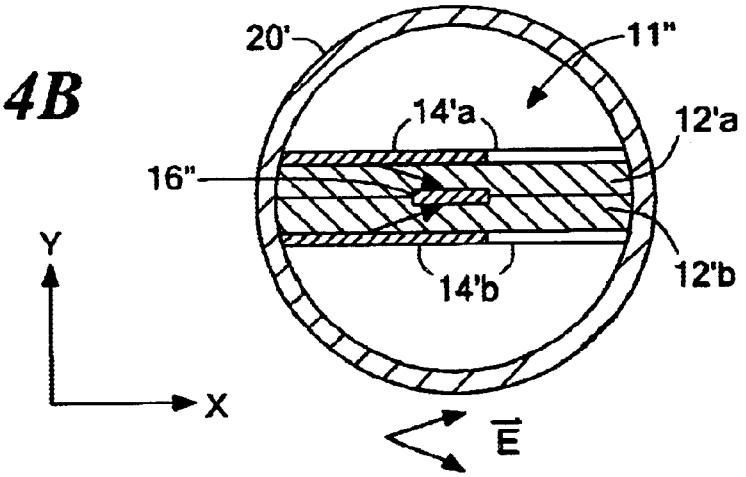
Figure 4C:
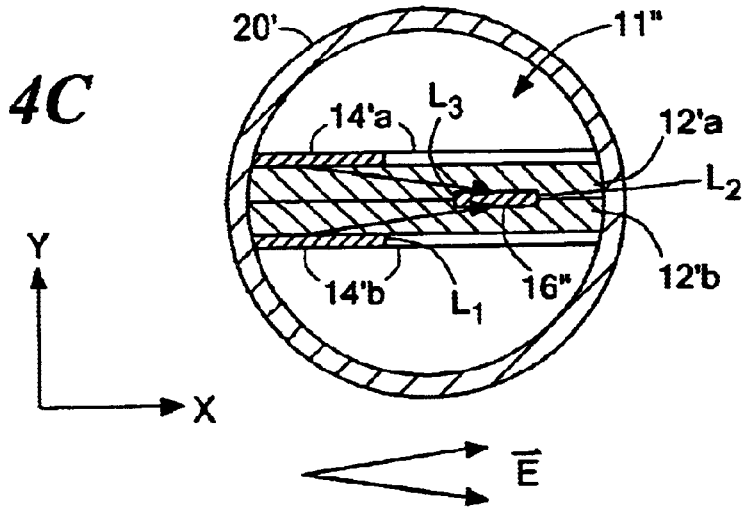
Figure 4D:
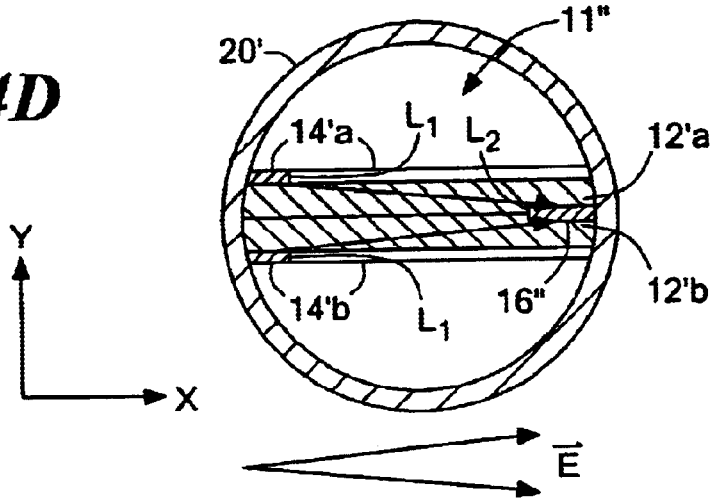
Figure 4E:
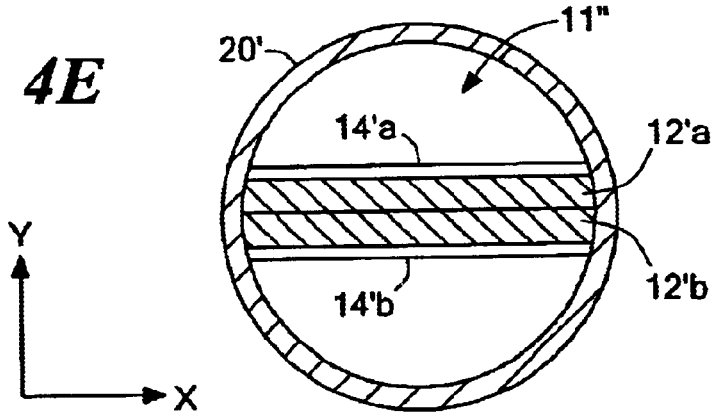
Figure 4F:
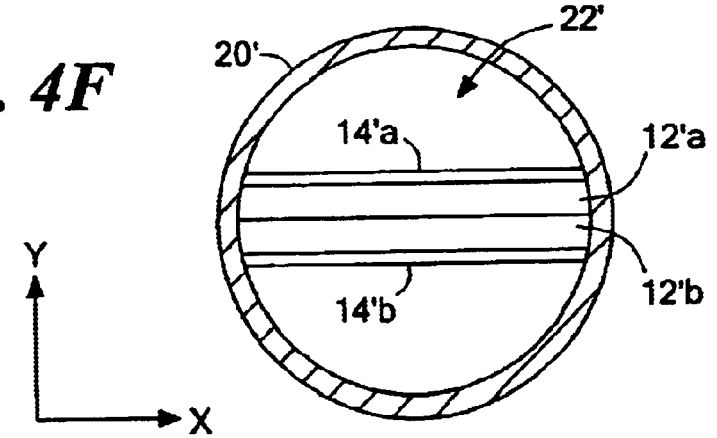

Referring now to FIGS. 3, 4 and 4A–4F, a microstrip to circular waveguide transition 10' is shown. The transition 10' includes an elongated circular waveguide portion 20'. The transition 10' includes a microstrip circuit portion 11' disposed within a proximal portion of (here the left end of) the circular waveguide 20'. The microstrip circuit portion 11' includes a strip conductor 16' disposed in a strip conductor plane. The strip conductor 16' extends along a longitudinal axis, here the Z-axis, of the circular waveguide portion 20'. The microstrip circuit portion 11' includes a ground plane 14' separated from the strip conductor The transition 10' terminates in a circular waveguide 22' (FIG. 4F). Disposed within the circular waveguide portion 20' between the microstrip circuit 11' and the circular waveguide 22' is a stripline circuit portion 11". The stripline circuit portion 11" includes a strip conductor 16" disposed in a strip conductor plane. The strip conductor 16" is formed to join the strip conductor 16' of the stripline circuit portion 11" through a taper 21, as shown in FIG. 3. The strip conductor 16" extends along the longitudinal axis, Z, of the circular waveguide portion 20' from a first (here left side) region, $R_1$, of the transition 10' to a longitudinally spaced second region, $R_2$, of the transition 10'. The stripline circuit portion 11" includes a pair of overlying ground planes 14'*a,* 14'*b* extending along the longitudinal axis, Z, from the first region $R_1$ to the second region $R_2$. The pair of ground planes 14'*a,* 14'*b* are disposed in overlying planes parallel to the strip conductor plane and are separated from the strip conductor 16" by a pair of dielectric substrates 12'*a,* 12'*b,* as shown. The strip conductor 16" is spaced from a pair of diametrically opposed first portions of the sidewalls of the circular waveguide 20' the first region $R_1$ and bends towards a first of a pair of diametrically opposed second portions of the sidewalls and away from the second one of the pair of opposed second portions of the sidewalls as such strip conductor extends within the waveguide section towards the second region $R_2$.

The pair of overlying ground planes 14'*a,* 14'*b* is disposed adjacent the diametrically opposed sidewall portions of the sidewalls in the first region $R_1$ of the transition and bend away from the first one of the pair of diametrically opposed second portions of the sidewalls and towards the second one of the diametrically opposed second portions of the sidewalls as such pair of ground planes extends within the waveguide section towards the second region, $R_2$.

The stripline circuit portion 11" is disposed along a diameter of the circular waveguide portion 20'. The strip conductor 16" is in electrical contact with the first of the pair of diametrically opposed second portions of the sidewalls of waveguide 20' at the second region $R_2$. The pair of ground planes 14'*a,* 14'*b* is in electrical contact with the diametrically opposed second portions of the sidewalls of waveguide 20' in the second region $R_2$. The pair of ground planes is in electrical contact with the diametrically opposed sidewall portions of the sidewalls in the first region $R_1$ of the transition 10'. Overlying edges of the pair of ground planes 14'*a,* 14'*b* are disposed along first fin-shaped lines $L_1$ as such pair of ground planes extend from the first region $R_1$ to the second region $R_2$. Overlying edges of the strip conductor 16" are disposed along second fin-shaped lines $L_2$, $L_3$ as such strip conductor 16" extends from the first region $R_1$ to the second region $R_2$. The first and second fin-shaped lines $L_3$ and $L_1$ diverge one from the other in opposite directions in the second region $R_2$ as shown in FIG. 3.

The transition 10' described above solves the mode purity problem by using stripline in the critical fin-shaped line region as shown. The microstrip is first changed to stripline with the taper 21, as is commonly done in the practice of the art. The stripline provides two symmetrically located ground planes in the fin line region, which make two symmetrical E field vectors as shown. The Y-axis components of these vectors will add to excite the desired mode in the circular waveguide. The X-axis components of these two vectors are in opposite directions, and will thus cancel out the contribution of coupling to the undesired orthogonal mode in the circular waveguide. This cancellation, due to symmetry, is not related to any particular wavelength, and thus the phenomenon is very broadband.

A number of embodiments of the invention have been described. Nevertheless, it will be understood that various modifications may be made without departing from the spirit and scope of the invention. Accordingly, other embodiments are within the scope of the following claims.

What is claimed is:

1. A microstrip to circular waveguide transition, comprising:

an elongated circular waveguide portion;

a stripline circuit portion disposed within the circular waveguide section, such stripline portion comprising:

a strip conductor disposed in a strip conductor plane, such strip conductor extending along a longitudinal axis of the circular waveguide portion from a first region of the transition to a longitudinally spaced second region of the transition;

a pair of overlying ground planes extending along the longitudinal axis from the first region to the second region and disposed in overlying planes parallel to the strip conductor plane, such pair of ground planes being dielectrically separated from the strip conductor;

wherein the strip conductor is spaced from a pair of diametrically opposed first portions of the sidewalls in the first region and bends towards a first of a pair of diametrically opposed second portions of the sidewalls and away from the second one of the pair of opposed second portions of the sidewalls as such strip conductor extends within the waveguide portion towards the second region;

wherein the pair of overlying ground planes is disposed adjacent the diametrically opposed sidewall portions of the sidewalls in the first region of the transition and bend away from the first one of the pair of diametrically opposed second portions of the sidewalls and towards the second one of the diametrically opposed second portions of the sidewalls as such pair of ground planes extends within the waveguide section towards the second region.

2. The microstrip to circular waveguide transition recited in claim 1 wherein the strip conductor plane is disposed along a diameter of the circular waveguide portion.

3. The microstrip to circular waveguide transition recited in claim 1 wherein the strip conductor is in electrical contact with the first of the pair of diametrically opposed second portions of the sidewalls.

4. The microstrip to circular waveguide transition recited in claim 3 wherein the pair of ground planes strip conductor is in electrical contact with the second one of the pair of diametrically opposed second portions of the sidewalls.

5. The microstrip to circular waveguide transition recited in claim 4 wherein the pair of ground planes is in electrical contact with the diametrically opposed sidewall portions of the sidewalls in the first region of the transition.

6. The microstrip to circular waveguide transition recited in claim 4 wherein overlying edges of the pair of ground planes are disposed along a first fin-shaped line as such pair of ground planes extend from the first region to the second region.

7. The microstrip to circular waveguide transition recited in claim 6 wherein overlying edges of the strip conductor are disposed along a second fin-shaped line as such strip conductor extends from the first region to the second region.

8. The microstrip to circular waveguide transition recited in claim 7 wherein first and second fin-shaped lines diverge one from the other in opposite directions in the second region.

9. The microstrip to circular waveguide transition recited in claim 1 wherein overlying edges of the pair of ground planes are disposed along a first fin-shaped line as such pair of ground planes extend from the first region to the second region.

10. The microstrip to circular waveguide transition recited in claim 9 wherein overlying edges of the strip conductor are disposed along a second fin-shaped line as such strip conductor extends from the first region to the second region.

11. The microstrip to circular waveguide transition recited in claim 10 wherein first and second fin-shaped lines diverge one from the other in opposite directions in the second region.

* * * * *

UNITED STATES PATENT AND TRADEMARK OFFICE

CERTIFICATE OF CORRECTION

PATENT NO. : 6,624,716 B2
DATED : September 23, 2003
INVENTOR(S) : Goff

It is certified that error appears in the above-identified patent and that said Letters Patent is hereby corrected as shown below:

Column 2,
Lines 62 and 65, delete “In one embodiment the” and replace with -- In one embodiment, the --.

Column 3,
Lines 1 and 12, delete “In one embodiment the” and replace with -- In one embodiment, the --.
Lines 4 and 8, delete “In one embodiment overlying” and replace with -- In one embodiment, overlying --.
Line 52, delete “conductor” and replace with -- conductor 16’ by a dielectric substrate 12’. --.

Column 6,
Line 8, delete “in claim 4” and replace with -- in claim 1 --.
Line 21, delete “in claim 1” and replace with -- in claim 4 --.

Signed and Sealed this

Eleventh Day of May, 2004

JON W. DUDAS
*Acting Director of the United States Patent and Trademark Office*